US011346241B2

(12) United States Patent
Lefebvre et al.

(10) Patent No.: US 11,346,241 B2
(45) Date of Patent: May 31, 2022

(54) VARIABLE GUIDE VANES ASSEMBLY

(71) Applicant: PRATT & WHITNEY CANADA CORP., Longueuil (CA)

(72) Inventors: Guy Lefebvre, St-Bruno-de-Montarville (CA); René Paquet, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 16/885,846

(22) Filed: May 28, 2020

(65) Prior Publication Data

US 2021/0372292 A1 Dec. 2, 2021

(51) Int. Cl.
*F01D 17/16* (2006.01)
*F01D 17/26* (2006.01)

(52) U.S. Cl.
CPC ..... *F01D 17/162* (2013.01); *F01D 17/26* (2013.01)

(58) Field of Classification Search
CPC ..... F01D 17/16; F01D 17/162; F01D 17/165
See application file for complete search history.

(56) References Cited

U.S. PATENT DOCUMENTS 2,805,818 A 9/1957 Ferri
3,352,537 A * 11/1967 Petrie ..... F01D 17/162 60/39.01
3,850,544 A * 11/1974 Ciokajlo ..... F01D 17/162 415/149.4
8,894,361 B2 * 11/2014 Rodriguez ..... F02C 7/06 415/160
9,194,329 B2 11/2015 Merry et al.
9,784,365 B2 10/2017 Marshall et al.
11,015,477 B2 * 5/2021 Lagarde ..... F01D 17/162
2015/0030438 A1 * 1/2015 Takahashi ..... F04D 29/563 415/159
2019/0390563 A1 12/2019 Lagarde et al.
2020/0080475 A1 * 3/2020 Baladi ..... F02C 3/04

FOREIGN PATENT DOCUMENTS

WO WO9002256 A1 3/1990

OTHER PUBLICATIONS

European Search Report issued in counterpart EP application No. 21176746.2 dated Nov. 3, 2021.

* cited by examiner

*Primary Examiner* — Justin D Seabe
(74) *Attorney, Agent, or Firm* — Norton Rose Fulbright Canada LLP

(57) ABSTRACT

A variable guide vane (VGV) assembly, has: a casing enclosing a cavity and defining apertures distributed around a central axis; variable guide vanes (VGVs) distributed around the central axis and having an airfoil portion extending from a first end to a second end along a pivot axis, and a shaft portion pivotably received within the apertures; vane drive members secured to the shaft portions of the VGVs and located within the cavity, a unison transmission member within the cavity and rotatable about the central axis and engaged to the vane drive members, and an external mechanism secured to the second end of one of the VGVs and disposed outside the cavity, the external mechanism engageable by an actuator for rotating the one of the VGVs about its pivot axis, thereby rotating the unison transmission member, which, in turn, drives a remainder of the VGVs in rotation.

20 Claims, 2 Drawing Sheets

VARIABLE GUIDE VANES ASSEMBLY

TECHNICAL FIELD

The application relates generally to variable guide vanes in a gas turbine engine.

BACKGROUND OF THE ART

Gas turbine engines sometimes have variable guide vanes (VGVs) disposed in a section of an airflow duct of a compressor or turbine section. The guide vanes are adjustable in an angular orientation in order to control the airflow being directed through the airflow duct. An actuator positioned outside the airflow duct is conventionally used to actuate adjustment of the angular orientation of the VGVs. In some cases, gears are used to communicate angular movements to the vanes. These gears may be subjected to wear and fretting.

SUMMARY

In one aspect, there is provided a variable guide vane (VGV) assembly, comprising: a casing enclosing a cavity hydraulically connectable to a lubrication system, the casing defining apertures circumferentially distributed around a central axis; variable guide vanes (VGVs) circumferentially distributed around the central axis, each VGVs having an airfoil portion extending from a first end to a second end along a pivot axis, and a shaft portion protruding from the first end and extending away from the airfoil portion and pivotably received within the apertures; vane drive members secured to respective ones of the shaft portion of the VGVs and located within the cavity, a unison transmission member within the cavity and rotatable about the central axis, the unison transmission member engaged to the vane drive members, and an external mechanism secured to the second end of one of the VGVs, the external mechanism disposed outside the cavity, the external mechanism engageable by an actuator for rotating the one of the VGVs about its pivot axis, thereby rotating the unison transmission member, which, in turn, drives a remainder of the VGVs in rotation.

In another aspect, there is provided a gas turbine engine having a central axis, comprising a gaspath defined between an inner wall and an outer wall, a cavity located radially inwardly of the inner wall and hydraulically connected to a lubricant source, guide vanes circumferentially distributed around the central axis, the guide vanes having airfoil portions extending between the inner and outer walls across the gaspath and along pivot axes, the guide vanes having inner shaft portions protruding from the airfoil portions and pivotably received within apertures defined through the inner wall and outer shaft portions protruding from the airfoil portions and pivotably received within apertures defined through the outer wall, vane drive members secured to the inner shaft portions and located within the cavity, a unison transmission member radially supported by the inner wall within the cavity and rotatable relative the inner wall about the central axis, the unison transmission member engaged to the vane drive members, and an external mechanism secured to the outer shaft portion of one of the guide vanes, the external mechanism engaged to an actuator for rotating the one of the guide vanes about a respective pivot axis thereby rotating the unison transmission member about the central axis and rotating a remainder of the guide vanes about the pivot axes.

DESCRIPTION OF THE DRAWINGS

Reference is now made to the accompanying figures in which.

DETAILED DESCRIPTION

Figure 1:
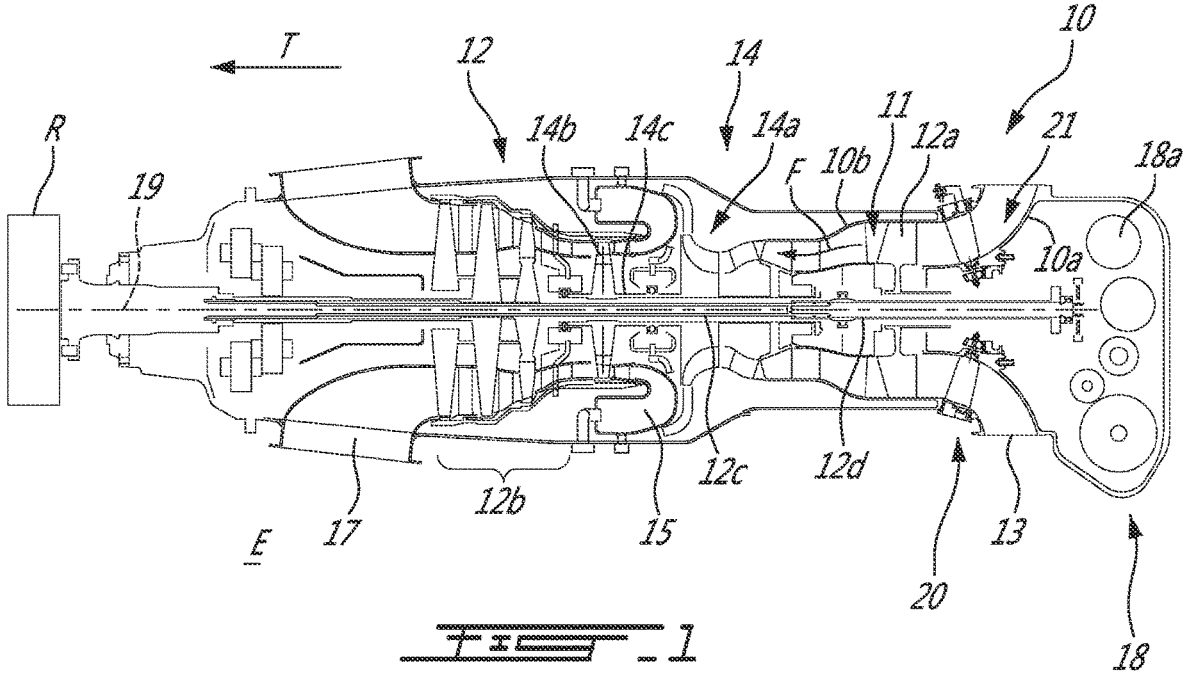
FIG. 1 is a schematic cross-sectional view of a reverse flow gas turbine engine in accordance with one embodiment.

FIG. 1 illustrates a first example of a multi-spool gas turbine engine 10 of a type preferably provided for use in subsonic flight, and generally comprising an engine core having a turbomachinery with multiple spools which perform compression to pressurize atmospheric air received through an air inlet 13, and which extract energy from combustion gases before they exit the engine via an exhaust outlet 17. The engine core further comprises a core gaspath 11 to direct gases from the air inlet 13 to the exhaust outlet 17. The core gaspath 11 is annular and extends around an engine central axis 19. In the embodiment shown, the engine 10 is a reverse-flow engine in that a direction of a flow F within the gaspath 11 corresponds to a direction of travel T of the engine 10. Other configurations are contemplated and the present disclosure may apply to other type of engines, such as, a turbofan engine.

The term "spool" is herein intended to broadly refer to drivingly connected turbine and compressor rotors and is, thus, not limited to a compressor and turbine assembly on a single shaft. It may include a rotary assembly with multiple shafts geared together.

In the embodiment shown in FIG. 1, the engine core includes a low pressure (LP) spool 12 and a high pressure (HP) spool 14. The LP spool 12 generally comprises an LP compressor 12*a* for pressurizing air received from the air inlet 13 and an LP turbine 12*b* for extracting energy from combustion gases discharged from a combustor 15 in which compressed air is mixed with fuel and ignited for generating an annular stream of hot combustion gases. The LP turbine 12*b* is herein connected mechanically to the LP compressor 12*a* via a LP shaft 12*c*. Flow communication between the two LP compressor 12*a* and the low pressure turbine 12*b* is through the high pressure spool 14 and the combustor 15 via the core gaspath 11. According to one aspect of the embodiment shown in FIG. 1, the LP compressor 12*a* and the LP turbine 12*b* are coaxially mounted for rotation about the central axis 19 of the engine 10.

The HP spool 14 generally comprises an HP compressor 14*a* connected in flow communication with the LP compressor 12*a* for receiving pressurized air therefrom via the core gaspath 11. The HP spool 14 further comprises an HP turbine 14*b*, which is herein located immediately downstream of the combustor 15. The HP turbine 14*b* is drivingly connected to the HP compressor 14*a* via an HP shaft 14*c*. The HP shaft 14*c* is herein coaxial to the engine central axis 19. In the illustrated embodiment, the LP compressor 12*a*, the LP turbine 12*b*, the HP turbine 14*b* and the HP compressor 14*a* are all mounted for rotation about the engine central axis 19.

In the embodiment shown, the LP spool 12 is drivingly connected to an accessory gearbox (AGB) 18, including gears 18*a*, that is rear mounted and drivingly connected to the LP pressure spool 12 via a torque shaft 12*d* engaged to the LP shaft 12*c* via a spline coupling. The AGB 18 is coaxially mounted at the rear end of the engine 10, and upstream of the LP compressor 12*a*, for providing drive outputs to various accessories (e.g. fuel pump, starter-generator, oil pump, scavenge pump, etc.). Alternatively, the AGB 18 is drivingly engaged to the HP spool 14 by having the HP shaft 14*c* extending axially beyond the HP compressor 14*a* through a central bore of the LP compressor 12*a* to provide a drive input to the AGB 18. Other configurations are contemplated.

The LP turbine 12*b* is also known as the power turbine. According to the illustrated embodiment, the LP turbine 12*b* drives a rotatable load R, such as a propeller, which provides thrust for flight and taxiing in aircraft applications. However, it is understood that the LP turbine 12*b* may drive a helicopter main rotor(s) and/or tail rotor(s), pump(s), generator(s), gas compressor(s), marine propeller(s), etc.

Referring to FIGS. 1-4, in the embodiment shown, the engine 10 has a variable inlet guide vane (VIGV) assembly 20. The VIGV assembly 20 includes a plurality of inlet guide vanes 22, referred to herein below simply as "vanes". The vanes 22 have airfoil portions 22*a* extending across the gaspath 11 between an inner wall 10*a* and an outer wall 10*b* of the engine 10. These walls 10*a*, 10*b* are also referred to as casings. The vanes 22 are rotatable about pivot axes A to change an angle of attack of the vanes 22 relative to the flow F flowing within the gaspath 11.

In the embodiment shown, the VIGV assembly 20 is located downstream of the inlet 13 of the engine 10 and upstream of the LP compressor 12*a*. However, any other suitable location is contemplated. It will be appreciated that although the VIGV assembly 20 is depicted as being located at an inlet section of the engine 10 upstream of the LP compressor 12, the VIGV assembly 20 may be located at any other suitable locations, such as downstream of the combustor 15, between the LP and HP compressors 12*a*, 14*a*, and/or between the LP and HP turbines 12*b*, 14*b*.

Herein, the inlet 13 of the engine 10 is defined by an inlet duct 21; the inlet duct 21 curving from being oriented substantially radially relative to the engine central axis 19 at the air inlet 13 to being oriented substantially axially upstream of the LP compressor 12*a* and downstream of the vanes 22. The inner and outer walls 10*a*, 10*b* of the engine 10 defines the inlet duct 21 and curve from a substantially radial orientation at the inlet 13 to a substantially axial orientation upstream of the LP compressor 12*a* and downstream of the VIGV assembly 20. Herein, the VIGV assembly 20 is located within the inlet duct 21 at a location were the radii of both of the inner and outer walls 10*a*, 10*b* decrease in a direction of the flow F of air flowing into the gaspath 11.

Figure 3:
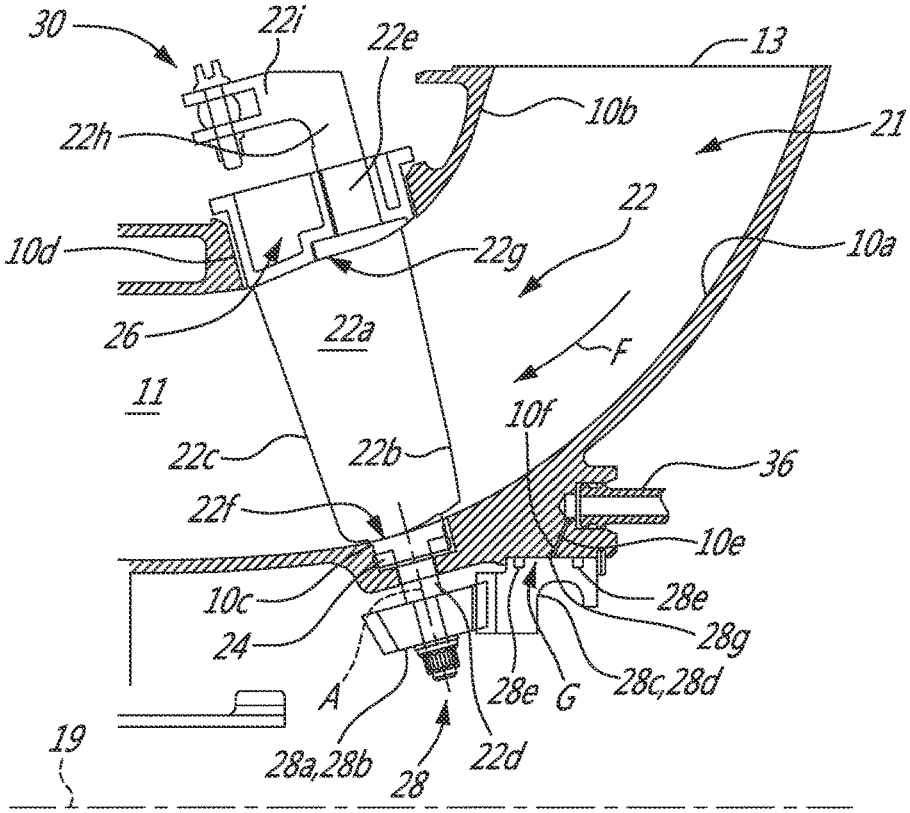
FIG. 3 is an enlarged view of a top portion of FIG. 2.
Figure 4:
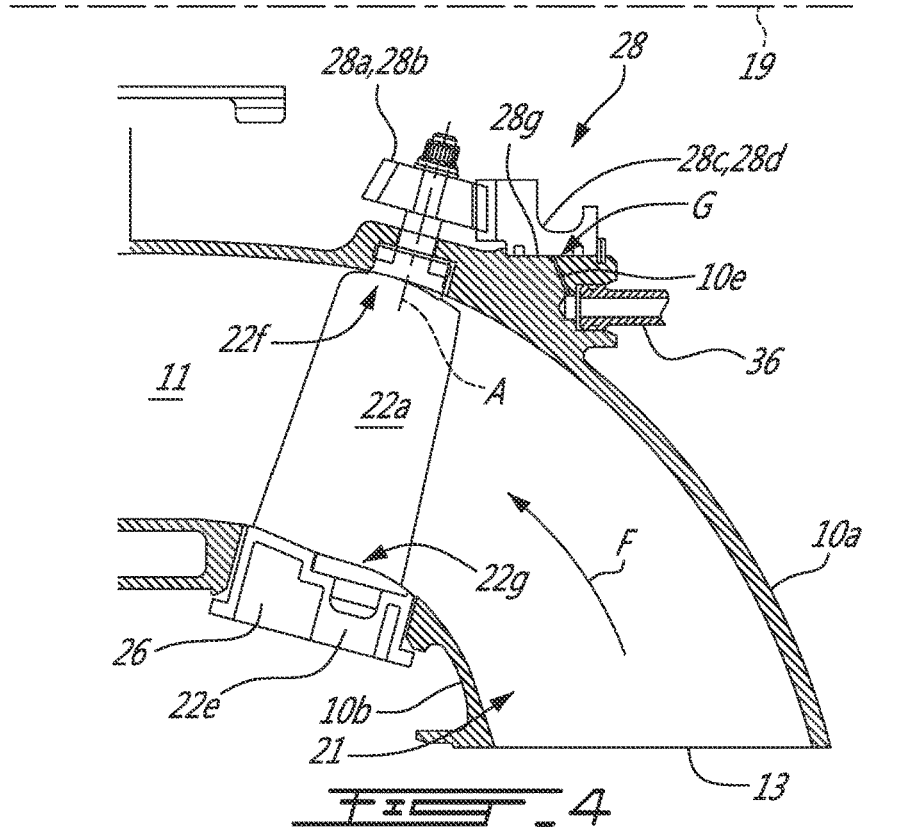
FIG. 4 is an enlarged view of a bottom portion of FIG. 2.

Referring to FIGS. 3-4, the vanes 22 have leading edges 22*b* and trailing edges 22*c* spaced apart form the leading edges 22*b* by chords; both of the leading and trailing edges 22*b*, 22*c* extending along a span of the airfoil portions 22*a* of the vanes 22. The vanes 22 have opposed pressure and suction sides extending along the span and from the leading edges 22*b* to the trailing edges 22*c*.

The vanes 22 have inner shaft portions 22*d* and outer shaft portions 22*e* protruding respectively from inner and outer ends 22*f*, 22*g* of the airfoil portions 22*a* of the vanes 22. The inner shaft portions 22*d* are pivotably received within correspondingly shaped apertures 10*c* defined through the inner wall 10*a*. Bushings 24 are disposed around the inner shaft portions 22*d* to reduce friction between a peripheral wall of the apertures 10*c* defined in the inner wall 10*a* and the inner shaft portions 22*d*. It will be appreciated that any suitable type of bearings may be used. Bushings or other bearings may also be disposed around the outer shaft portions 22*e*.

In the depicted embodiment, guiding members 26 are received within apertures 10*d* defined through the outer wall 10*b*. These guiding members 26 bridge gaps between peripheral walls of the apertures 10*d* and the outer shaft portions 22*e*. This guiding member 26 may assist the rotation of the vanes 22 relative to the outer wall 10*d*. Other configurations are contemplated and, in some cases, the guiding member 26 may be omitted. The guiding member 26 is a housing for the outer shaft protrusions 22*e* and acts as a portion of a wall delimiting the compressor gaspath.

As discussed above, the vanes 22 are pivotable about their pivot axes A. The VIGV assembly 20 includes a mechanism 28 for coordinating pivot movements of the vanes 22. In the embodiment shown, the mechanism 28 includes vane drive members 28*a* secured to the inner shaft portions 22*d* of the vanes 22. These members 28*a* can include gears 28*b*. In the embodiment shown, the gears are bevel gears. It will be appreciated that any other suitable drive transmission members may be used such as, for instance, fork and gear. The vane drive members 28*a* are engaged with a unison transmission member 28*c*, which is, in the embodiment shown, a ring gear 28*d* that extends circumferentially around the central axis 19 of the engine 10. As shown in FIGS. 3-4, the gears 28*b* secured to the inner shaft portions 22*d* of the vanes 22 are meshed with the ring gear 28*d*. Herein, the vane drive members 28*a* are secured to the inner shaft portions 22*d* with nuts. Any suitable way to secured the vane drive members 28*a* the inner shaft portions 22*d* is contemplated including having the vanes 22 monolithically formed with the members 28*a*.

It will be appreciated that, alternatively, the unison transmission member 28*c* may be a annular ring and the vane drive members 28*a* may be a plurality of arms pivotably connected to the annular ring and fixedly mounted on the inner shaft portions 22*d*. Rotation of the annular ring changing angles defined between the arms and the annular ring thereby rotating the vanes about their pivot axes A.

The unison transmission member 28*c* is radially supported by the inner wall 10*a* and is rotatable about the engine central axis 19 relative to the inner wall 10*a*. Since the unison transmission member 28*c* is engaged to the vane drive members 28*a*, rotation of the unison transmission member 28*c* about the engine central axis 19 translates into rotation of the vanes 22 about their respective pivot axes A.

Figure 2:
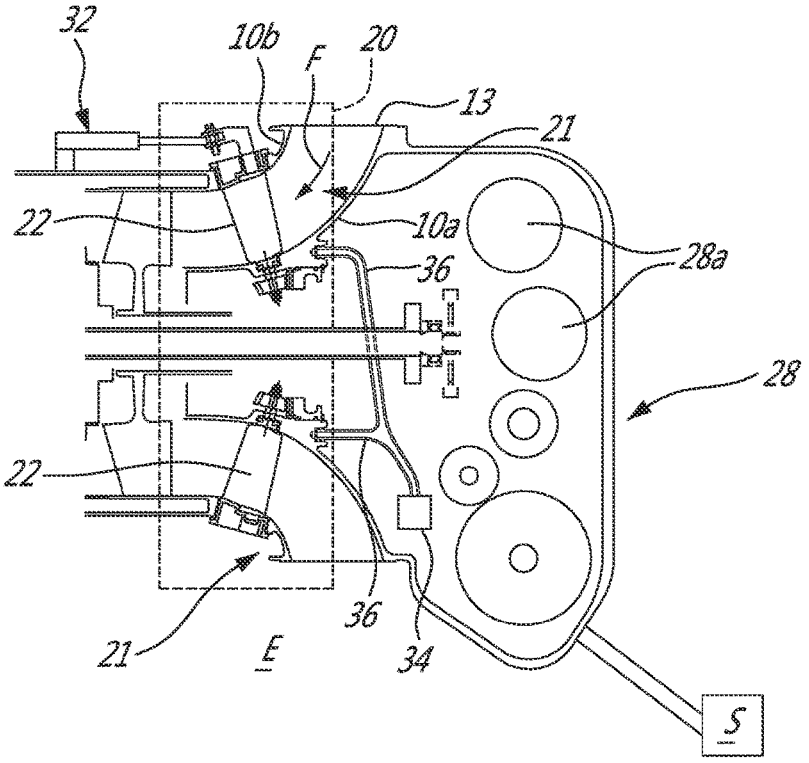
FIG. 2 is an enlarged view of a portion of FIG. 1.

Referring to FIGS. 2-4, with use, wear and tear may occur on the members 28*a*, 28*c*, more specifically on the teeth of the gears and ring gear 28*b*, 28*d*. In the embodiment shown, the mechanism 28 is located within a cavity C of the engine 10. Herein, the cavity C is defined by the accessory gearbox 18. The cavity C is hydraulically connected to a lubricant source S, such as an oil source, for lubricating the gears 18*a* of the AGB 18. Consequently, the mechanism 28 is exposed to a lubricated environment. This may increase a life span of the mechanism, more specifically, of the gears 28*b*, 28*d* of the mechanism 28. The mechanism 28 may substantially be protected from an environment E outside the engine 10 by being contained with the lubricated cavity C of the AGB 18. A life span of the disclosed vane assembly 20 may be greater than that of a vane assembly in which components used to transmit rotation of the vanes are located outside a lubricated cavity.

It will be appreciated that the lubricated cavity C may be any suitable cavity and not necessarily the cavity C of the AGB. For instance, the mechanism 28 may be located with a bearing cavity of the engine 10 that contains bearing radially supporting either one of the LP and HP shafts 12*c*, 14*c*.

In the embodiment shown, the unison transmission member 28*c* is spaced apart from the inner wall 10*a* by a gap G. More specifically, the unison member 28*c* has an annular face 28*g* that faces the inner wall 10*a*; the gap G located between the annular face 28*g* and the inner wall 10*a*. In the present embodiment, the annular face 28*g* faces a direction that is solely radial and free of an axial component relative to the central axis 19. In a particular embodiment, having the annular face 28*g* facing a direction being solely radial and free of an axial component relative to the central axis 19 allows to minimize an axial play between the bevel gears 28*b* and the ring gear 28*d*. This may lead to a better control of wear. The gap G is hydraulically connected to fluid passages 10*e* defined by the inner wall 10*a*. The fluid passages 10*e* are hydraulically connected to the lubricant source S. As shown in FIG. 2, a pump 34 is disposed within the cavity C and has an inlet hydraulically connected to the lubricant source S, either directly or via the cavity C, and an outlet hydraulically connected to the fluid passages 10*e* via suitable conduits 36. Any suitable connection to bring lubricant from the lubricant source S to the gap G is contemplated. In the embodiment shown, the inner wall 10*a* defines apertures for receiving coupling ends of the conduits 36. Said apertures are hydraulically connected to the gap G via the fluid passages 10*e*.

Referring more particularly to FIG. 3, two seals 28*e* are disposed between the inner wall 10*a* of the engine 10 and the unison member 28*c*. The two seals 28*e* extend circumferentially around the engine central axis 19 and are spaced apart from one another and create a sealing engagement between the unison member 28*c* and the inner wall 10*a* to contain lubricant within the gap G. Herein, the two seals 28*e* are ring seals received within correspondingly shaped grooves defined by the union member 28*c*. The seals 28*e* may alternatively be received with grooves defined in the inner wall 10*a*. As shown in FIG. 3, an outlet 10*f* (FIG. 3) of the fluid passage 10*e* opens to the gap G, between the two seals 28*e*. The seals 28*e* may be ring seals, but any suitable seal may be used. The seals 28*e* are biased between the unison member 28*a* and the inner wall 10*a* to create a sealing engagement therebetween.

Referring to FIG. 3, one of the vanes 22, referred to below as the master vane, includes a driving mechanism 30 that is engaged by an actuator 32 (FIG. 2) for rotating the master vane about its pivot axis A. In the embodiment shown, the master vane is the only vane that is engaged by an actuator. A remainder of the vanes 22 a slave vanes. The driving mechanism 30 is external to the cavity C. Rotation of the master vane translates into rotation of the unison transmission member 28*c* about the engine central axis 19 and in rotation of a remainder of the vanes 22, referred to as slave vanes, about their respective pivot axes A.

As shown in FIG. 3, the driving mechanism 30 includes an external shaft portion 22*h* extending from the outer end 22*g* of the master vane and a lever 22*i* protruding at an angle from the external shaft portion 22*h*. The lever 22*i* is engaged to the actuator 32. Any suitable way of securing the lever 22*i* to the actuator 32 is contemplated. It will be appreciated that the actuator 32 can take various forms. For instance, it can be provided in the form of a linear actuator such as illustrated in FIG. 2, such as a piston and cylinder arrangement, operable to apply a tangential force to the lever 28*i* relative to the pivot axis A of the master vane 22.

In the depicted embodiment, only a single vane 22, the master vane, needs to be engaged by the actuator 32 to pivot all of the vanes 22 about their respective pivot axes A using the mechanism 28 located inside the cavity C and, therefore, substantially exposed to lubricant. The injection of lubricant in the gap G may ensure that rotation of the unison member 28*c* about the central axis 19 and relative to the inner wall 10*a* is as low-friction as possible to limit an amount of force applied on the lever 22*i* of the master vane by the actuator 30. Lubricating the interface between the unison member 28*c* and the inner wall 10*a* and/or having the mechanism 28 in a lubricated cavity C may increase a lifespan of the vane assembly 20, reduce wear and tear on the components of the mechanism 28 compared to a configuration in which the components are external to a lubricated cavity. The disclosed vane assembly 20 may have an increased durability and may allow reducing maintenance costs.

Embodiments disclosed herein include:

A. A variable guide vane (VGV) assembly, comprising: a casing enclosing a cavity hydraulically connectable to a lubrication system, the casing defining apertures circumferentially distributed around a central axis; variable guide vanes (VGVs) circumferentially distributed around the central axis, each VGVs having an airfoil portion extending from a first end to a second end along a pivot axis, and a shaft portion protruding from the first end and extending away from the airfoil portion and pivotably received within the apertures; vane drive members secured to respective ones of the shaft portion of the VGVs and located within the cavity, a unison transmission member within the cavity and rotatable about the central axis, the unison transmission member engaged to the vane drive members, and an external mechanism secured to the second end of one of the VGVs, the external mechanism disposed outside the cavity, the external mechanism engageable by an actuator for rotating the one of the VGVs about its pivot axis, thereby rotating the unison transmission member, which, in turn, drives a remainder of the VGVs in rotation.

B. A gas turbine engine having a central axis, comprising a gaspath defined between an inner wall and an outer wall, a cavity located radially inwardly of the inner wall and hydraulically connected to a lubricant source, guide vanes circumferentially distributed around the central axis, the guide vanes having airfoil portions extending between the inner and outer walls across the gaspath and along pivot axes, the guide vanes having inner shaft portions protruding from the airfoil portions and pivotably received within apertures defined through the inner wall and outer shaft portions protruding from the airfoil portions and pivotably received within apertures defined through the outer wall, vane drive members secured to the inner shaft portions and located within the cavity, a unison transmission member radially supported by the inner wall within the cavity and rotatable relative the inner wall about the central axis, the unison transmission member engaged to the vane drive members, and an external mechanism secured to the outer shaft portion of one of the guide vanes, the external mechanism engaged to an actuator for rotating the one of the guide vanes about a respective pivot axis thereby rotating the unison transmission member about the central axis and rotating a remainder of the guide vanes about the pivot axes.

Embodiments A and B may include any of the following elements, in any combinations:

Element 1: the vane drive members are vane gears and the unison transmission member is a unison gear meshed with the vane gears. Element 2: the vane gears are bevel gears. Element 3: the external mechanism includes an external shaft portion extending from the second end of the airfoil portion of the one of the VGVs and a lever protruding from the external shaft portion, the lever engageable to the actuator. Element 4: the unison transmission member is spaced apart from the casing by a gap, the gap hydraulically connected to a fluid passage defined by the casing, the fluid passage hydraulically connectable to a lubricant source. Element 5: two spaced-apart seals biased between the unison transmission member and the casing, the fluid passage having an outlet opening to the gap between the two spaced-apart seals. Element 6: the unison transmission member has an annular face facing the inner wall, the gap between the annular face and the inner wall, the annular face facing a direction free of an axial component relative to the central axis. Element 7: the second ends of the VGVs are located radially outwardly of the first ends relative to the central axis. Element 8: a radius of a portion of the casing decreases in a direction of a flow flowing between the vanes, the apertures located at the portion of the casing. Element 9: a shaft rotatable about the central axis and an accessory gearbox in driving engagement with the shaft, the accessory gearbox contained within the cavity. Element 10: the accessory gearbox is located upstream of a compressor section of the gas turbine engine relative to a flow in the gaspath, the guide vanes located upstream of the compressor section. Element 11: the gas turbine engine is a reverse-flow gas turbine engine comprising an output shaft for driving a rotatable load, the output shaft and accessory gearbox located at opposite ends of the gas turbine engine. Element 12: a direction of the flow within the gas path corresponds to a direction of travel of the gas turbine engine. Element 13: a radius of a portion of the inner wall decreases in a direction of a flow in the gaspath, the apertures defined through the inner wall located at the portion of the casing. Element 14: the vane drive members are vane gears and the unison transmission member is a unison gear meshed with the vane gears. Element 15: the external mechanism includes a lever protruding radially from the outer shaft portion of the one of the guide vanes, the lever engaged to the actuator. Element 16: the actuator is a linear actuator. Element 17: the unison transmission member is spaced apart from the inner wall by a gap, the gap hydraulically connected to a fluid passage defined by the inner wall, the fluid passage hydraulically connected to the lubricant source. Element 18: two spaced-apart seals located between the unison transmission member and the inner wall, the fluid passage having an outlet opening to the gap between the two spaced-apart seals.

The embodiments described in this document provide non-limiting examples of possible implementations of the present technology. Upon review of the present disclosure, a person of ordinary skill in the art will recognize that changes may be made to the embodiments described herein without departing from the scope of the present technology. For example, the lubricated cavity may be annular and extend circumferentially around the engine central axis and located radially outwardly of the outer wall of the engine. In such a case, the gears would be secured to the outer shaft portions of the vanes and the actuator would be located radially inwardly of the inner wall. Yet further modifications could be implemented by a person of ordinary skill in the art in view of the present disclosure, which modifications would be within the scope of the present technology.

The invention claimed is:

1. A variable guide vane (VGV) assembly, comprising: a casing enclosing a cavity hydraulically connectable to a lubrication system, the casing defining apertures circumferentially distributed around a central axis; variable guide vanes (VGVs) circumferentially distributed around the central axis, each VGVs having an airfoil portion extending from a first end to a second end along a pivot axis, and a shaft portion protruding from the first end and extending away from the airfoil portion and pivotably received within the apertures; vane drive members secured to respective ones of the shaft portion of the VGVs and located within the cavity, a unison transmission member within the cavity and rotatable about the central axis, the unison transmission member engaged to the vane drive members, and an external mechanism secured to the second end of one of the VGVs, the external mechanism disposed outside the cavity, the external mechanism engageable by an actuator for rotating the one of the VGVs about its pivot axis, thereby rotating the unison transmission member, which, in turn, drives a remainder of the VGVs in rotation.

2. The VGV assembly of claim 1, wherein the vane drive members are vane gears and the unison transmission member is a unison gear meshed with the vane gears.

3. The VGV assembly of claim 2, wherein the vane gears are bevel gears.

4. The VGV assembly of claim 1, wherein the external mechanism includes an external shaft portion extending from the second end of the airfoil portion of the one of the VGVs and a lever protruding from the external shaft portion, the lever engageable to the actuator.

5. The VGV assembly of claim 1, wherein the unison transmission member is spaced apart from the casing by a gap, the gap hydraulically connected to a fluid passage defined by the casing, the fluid passage hydraulically connectable to a lubricant source.

6. The VGV assembly of claim 5, comprising two spaced-apart seals biased between the unison transmission member and the casing, the fluid passage having an outlet opening to the gap between the two spaced-apart seals.

7. The VGV assembly of claim 5, wherein the unison transmission member has an annular face facing the inner wall, the gap between the annular face and the inner wall, the annular face facing a direction free of an axial component relative to the central axis.

8. The VGV assembly of claim 1, wherein the second ends of the VGVs are located radially outwardly of the first ends relative to the central axis.

9. The VGV assembly of claim 1, wherein a radius of a portion of the casing decreases in a direction of a flow flowing between the vanes, the apertures located at the portion of the casing.

10. A gas turbine engine having a central axis, comprising a gaspath defined between an inner wall and an outer wall, a cavity located radially inwardly of the inner wall and hydraulically connected to a lubricant source, guide vanes circumferentially distributed around the central axis, the guide vanes having airfoil portions extending between the inner and outer walls across the gaspath and along pivot axes, the guide vanes having inner shaft portions protruding from the airfoil portions and pivotably received within apertures defined through the inner wall and outer shaft portions protruding from the airfoil portions and pivotably received within apertures defined through the outer wall, vane drive members secured to the inner shaft portions and located within the cavity, a unison transmission member radially supported by the inner wall within the cavity and rotatable relative the inner wall about the central axis, the unison transmission member engaged to the vane drive members, and an external mechanism secured to the outer shaft portion of one of the guide vanes, the external mechanism engaged to an actuator for rotating the one of the guide vanes about a respective pivot axis thereby rotating the unison transmission member about the central axis and rotating a remainder of the guide vanes about the pivot axes.

11. The gas turbine engine of claim 10, comprising a shaft rotatable about the central axis and an accessory gearbox in driving engagement with the shaft, the accessory gearbox contained within the cavity.

12. The gas turbine engine of claim 11, wherein the accessory gearbox is located upstream of a compressor section of the gas turbine engine relative to a flow in the gaspath, the guide vanes located upstream of the compressor section.

13. The gas turbine engine of claim 12, wherein the gas turbine engine is a reverse-flow gas turbine engine comprising an output shaft for driving a rotatable load, the output shaft and accessory gearbox located at opposite ends of the gas turbine engine.

14. The gas turbine engine of claim 13, wherein a direction of the flow within the gas path corresponds to a direction of travel of the gas turbine engine.

15. The gas turbine engine of claim 12, wherein a radius of a portion of the inner wall decreases in a direction of a flow in the gaspath, the apertures defined through the inner wall located at the portion of the casing.

16. The gas turbine engine of claim 10, wherein the vane drive members are vane gears and the unison transmission member is a unison gear meshed with the vane gears.

17. The gas turbine engine of claim 10, wherein the external mechanism includes a lever protruding radially from the outer shaft portion of the one of the guide vanes, the lever engaged to the actuator.

18. The gas turbine engine of claim 17, wherein the actuator is a linear actuator.

19. The gas turbine engine of claim 10, wherein the unison transmission member is spaced apart from the inner wall by a gap, the gap hydraulically connected to a fluid passage defined by the inner wall, the fluid passage hydraulically connected to the lubricant source.

20. The gas turbine engine of claim 19, comprising two spaced-apart seals located between the unison transmission member and the inner wall, the fluid passage having an outlet opening to the gap between the two spaced-apart seals.

* * * * *